US006692044B2

(12) United States Patent
Plett

(10) Patent No.: US 6,692,044 B2
(45) Date of Patent: Feb. 17, 2004

(54) INTERNAL SLIDING CLOSURE LOCK

(76) Inventor: Benjamin Plett, Box 340, Rosenort, Manitoba, R0G 1W0 (CA)

( * ) Notice: Subject to any disclaimer, the term of this patent is extended or adjusted under 35 U.S.C. 154(b) by 0 days.

(21) Appl. No.: 10/050,120

(22) Filed: Jan. 18, 2002

(65) Prior Publication Data

US 2002/0105193 A1 Aug. 8, 2002

Related U.S. Application Data

(60) Provisional application No. 60/265,635, filed on Feb. 2, 2001.

(51) Int. Cl.[7] ..... E05C 3/04
(52) U.S. Cl. ..... 292/218; 292/215; 292/DIG. 46
(58) Field of Search ..... 292/218, 215, 292/159, 292, DIG. 46

(56) References Cited

U.S. PATENT DOCUMENTS 1,799,464 A * 4/1931 Hiser
2,494,754 A * 1/1950 Goughnour ..... 292/159
2,961,263 A * 11/1960 Ahlgren ..... 292/140
4,062,576 A * 12/1977 Jennings ..... 292/258
4,304,429 A * 12/1981 Gist ..... 292/258
4,407,539 A * 10/1983 Asp ..... 292/338
D289,849 S * 5/1987 Gist ..... 292/252
4,907,832 A * 3/1990 Permberton ..... 292/228

* cited by examiner

*Primary Examiner*—Gary Estremsky

(57) ABSTRACT

A sliding closure (door or window) lock has a rectangular tubular enclosure which has a plunger mounted on am interior camshaft. Rotation of the camshaft by a handle or lever moves the plunger between an extended position, where its serrated outer end frictionally engages an interior surface of the channel for the closure, and a retracted position without frictional engagement. The enclosure has an adjacent apertured flange to secure it to an inner surface of the closure. The device may be made of two plates in which case one plate forms two walls of the enclosure and the flange, and the other the other two walls and a thickness of the flange. A stub flange also with apertures on remote corner of the enclosure allows the plates to be fastened at the other side of the enclosure.

11 Claims, 2 Drawing Sheets

INTERNAL SLIDING CLOSURE LOCK

This application claims the benefit of Provisional application Ser. No. 60/265,635, filed Feb. 2, 2001.

This invention relates to locks for sliding closures doors, especially glass doors, or windows. Horizontally sliding glass doors or windows are common, and they are a common point of entry for breakins, typically by forcing the sliding portion of the door or window to move in its channel. If glass in the door or window is smashed no lock will prevent entry. Typically current sliding windows and doors are secured by a piece of material, typically metal, plastic or wood, in the channel preventing movement of the sliding portion.

BACKGROUND

Sliding doors (patio doors) and windows, have a need for a workable locking device. By nature of their construction the locks used on most sliding doors, etc., are easy targets for break and enter. The sliding door consists of a frame (upper guide, lower guide and sides), a fixed panel or window and a sliding door. To install the sliding door into the frame the upper guide must have room to lift the door into the upper guide, clearing the lower guide, then dropping the door down into/onto the lower guide. The regular lock for sliding doors is generally a downward hook, hooking onto a small bar attached to the side frame. To enter a room/home via the locked sliding door from outside, the break and enter expert needs only to lift the door with a pry bar, unhooking the lock, push the door to the side and to the inside of the room, gaining entry to the room/home. The need is for a locking device that prevents the lifting and side movement of the sliding door.

The invention comprises a extendible plunger mounted on a frame, attachable to a sliding door or similar closure, which when extended engages the channel in which the closure slides, conveniently a flange on, or integral with, the frame allows attachment to the closure.

PRIOR ART

Applicant is not aware of any closely related art.

It is a principal object of the invention to provide an extendible plunger mounted in a frame attachable to a sliding door or window, so that the plunger when extended engages the channel in which the door or window slides. It is a subsidiary object of the invention to mount the plunger on a cam, by rotation of which the plunger is extended and retracted. It is a further subsidiary object of the invention to provide a serrated edge on the plunger to engage the channel. It is a further subsidiary object to provide a serrated edge slanted into the channel away from the sliding door or window. It is a further subsidiary object that the plunger is substantially parallel to the sliding door or window within the frame and angled away from the sliding door outside the frame. It is a further subsidiary object that a flange for attachment to the sliding door or window be attached to the frame. It is a further subsidiary object that a flange for attachment to the sliding door or window be integral with the frame.

DESCRIPTION OF THE INVENTION

The invention in one broad aspect is directed to a lock for a closure sliding in channels. It has an attachment plate member to attach to an edge of the closure, and plunger means to engage one channel. The plunger means is extendible between a first retracted position where the plunger means does not engage the channel, and a second extended position where the plunger means engages the channel. Preferably the plunger means has a planar serrated end surface to engage the channel in second extended position. The serrated end surface when engaging is preferably coincident with the channel for maximum frictional engagement. Preferably the plunger means in extended position pivots about a pivot means operatively associated with the plate member in a plane substantially at right angles to the plate member. Preferably the pivot means is mounted in wall members extending outward of the plate member, in which it may be conveniently journalled. Preferably there is a stop member operatively associated with and spaced apart from the plate member which limits movement of the plunger means outward of the plate member. Preferably the stop member extends between the wall members. Most preferably the plunger means has a planar serrated end to engage the channel in second extended position, and the planar serrated end surface contacts the channel, when the plunger means contacts the stop member. The position of the stop member is preferably placed so that the serrated end surface when engaging is preferably coincident with the channel for maximum frictional engagement. Alternatively the serrated end surface may be angled into the channel away from the closure, again for frictional engagement. Preferably the plunger means pivots about a primary pivot means operatively associated with the plate member between first retracted and second extended position in a plane substantially at right angles to the plate member. Preferably in extended position the plunger means pivots about a secondary pivot means operatively associated with the primary pivot means.

Preferably the primary pivot means is mounted in wall members extending outward of the plate member and the secondary pivot means is mounted on the primary pivot means. Preferably there is a stop member extending between the wall members which limits movement of the plunger means outward of the plate member. Conveniently the primary pivot means is a spindle or shaft extending between the wall members, and the secondary pivot means is a cam mounted upon the shaft or spindle. The invention is not restricted to such pivot means, as those skilled in the art are aware numerous alternative arrangements are available. Preferably the plunger means has a planar serrated end to engage the channel in second extended position, and the planar serrated end surface contacts the channel, when the plunger means contacts the stop member.

In another broad aspect the invention is directed to a lock for closures sliding in channels. The lock comprises a rectangular enclosure having first and second opposed ends, first, second, third and fourth wall member. The first and third wall members are opposed, parallel, and spaced apart. The second and fourth wall members are also opposed, parallel and spaced apart, at right angles to and connecting the first and third wall members. There is a flange member operatively associated with and at right angles to the first wall member and projecting away from the rectangular enclosure. This flange member can abut and be fastened to an inner surface of the closure, and the first wall member can abut an edge of the closure. A camshaft extends between the second and fourth wall members, parallel to the first and third wall members, with cylindrical ends journalled into the second wall member and the fourth wall member. Its cam is journalled into a first end of a plunger means, which has a second serrated end projecting beyond the first end of the rectangular enclosure. When rotated the camshaft moves the second serrated end of the plunger means between a first retracted position beyond the first end of the enclosure and a second extended position further beyond the first end of the enclosure. The serrated end of the plunger means is generally planar and parallel to the channel, when touching the third wall member. In use the flange is affixed to an inner surface of the closure, and the first wall abuts an edge of the closure, and the plunger means extends into a channel in which the closure slides. When the plunger means is in first retracted position the serrated second end does not engage a surface of the channel, when in second extended position the serrated second end frictionally engages a surface of the channel, and movement of the closure in the direction of the lock, rotates the second serrated end of the plunger means into tighter frictional engagement.

The plunger means preferably has a first portion within the rectangular enclosure when retracted and a second portion outside the rectangular enclosure when retracted, the second portion being angled away from the closure. This gives greater moment to the frictional force created by shoving the closure toward the lock.

Instead of the serrated edge being parallel to the channel it may be angled toward it outward of the closure. Again this creates greater frictional force when shoving the closure toward the lock.

Preferably the cylindrical ends of the cam shaft are journalled into bearing blocks in the second and fourth wall members. More preferably the bearing blocks are exterior of the wall members and welded thereto. Conveniently the camshaft end nearest the flange has a handle outward of the flange to rotate the camshaft. The lock may comprise two abutting plates. A first rear plate has a first flange to abut the closure inner surface. The first wall member is joined on one side at right angles to the first flange. The fourth wall member is joined at the other side of the first wall member at right angles to the first wall member and extending beyond the rectangular enclosure. A second front plate has a second flange member to fit over the first flange member. There is a fifth wall member joined at right angles on one side to the second flange member to fit over a portion of the first wall member. The second wall member is joined at one side at right angles to the other side of the fifth wall member. The third wall member is joined at right angles at one side to the other side of the second wall member. There is a third flange joined at right angles to the other side of the third wall member to fit over a portion of the fourth wall member. The first and second flange members have a plurality of first apertures registrable with each other to allow fasteners to pass through the first apertures and secure the flanges together to a closure surface. The third flange and the fourth wall member having a plurality of second apertures registrable with each other to allow fasteners to pass through the second apertures and secure the third flange to the fourth wall member.

The invention when engaged prevents the lifting and side movement of the door. When activated the plunger means of the lock pushes against the upper guide/frame for the door putting downward pressure on the door. This downward pressure on the door top prevents upward movement of the door. The plunger means being angled slightly away from the door restricts the side movement of the door. The more side pressure applied to the door the more the plunger means digs into the upper guide/frame preventing the door being pushed open.

DESCRIPTION OF THE PREFERRED EMBODIMENTS

Figure 1:
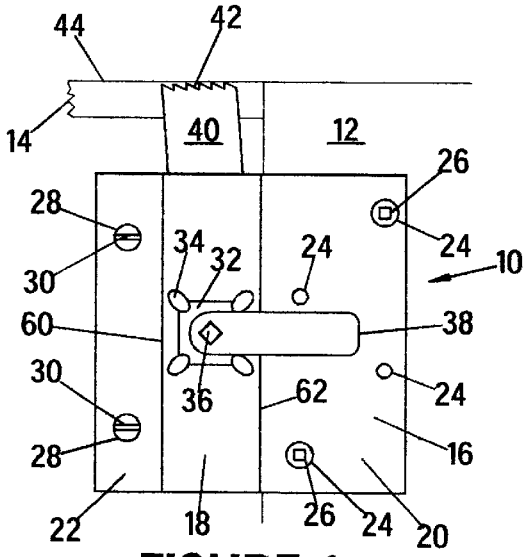
FIG. 1 shows a front elevational view of an embodiment of the invention.
Figure 2:
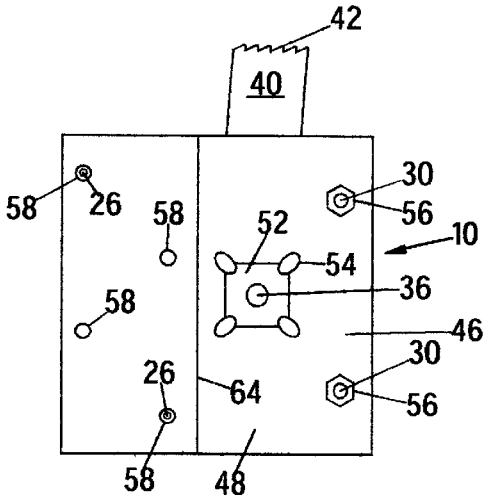
FIG. 2 shows a rear elevational view of the embodiment of FIG. 1.
Figure 3:
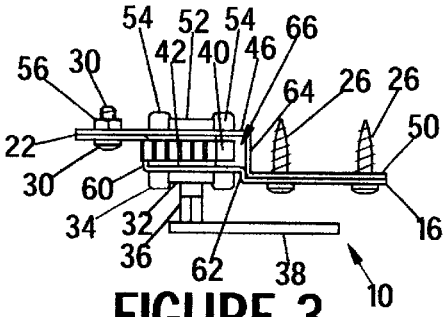
FIG. 3 shows a top plan view of the embodiment of FIG. 1.
Figure 4:
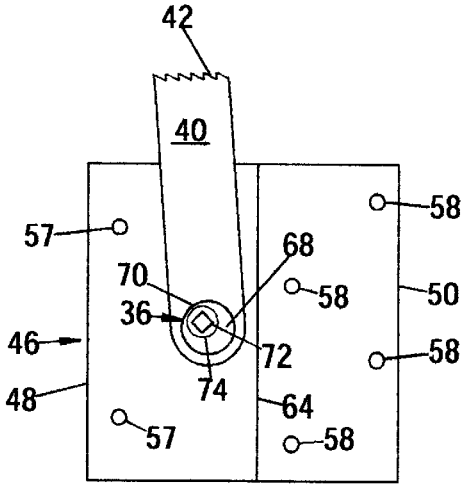
FIG. 4 shows a front elevational view of the embodiment of FIG. 1 with the front plate removed.
Figure 5:
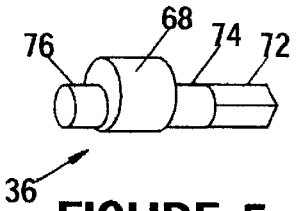
FIG. 5 shows a cam shaft of the invention.

The invention is illustrated but not restricted by reference to the preferred embodiments. Numeral 10 generally indicates a lock of the invention mounted on moving closure 12 (door, door frame or window frame) sliding in channel 14. Lock 10 has front plate 16 with central channel portion 18 and side flanges 20 and 22. Flange 20 has four screw holes 24, two of are occupied by attachment screws 26, attaching it to closure 12. Flange 22 has two screw holes 28 both occupied by bolts 30. Channel portion 18 has front bearing block 32 spot welded to channel portion 18 by welds 34, shaft 36 passes through front bearing block 32 and is rotatable by handle 38. Plunger 40 has serrated top 42 which engages top 44 of channel 14. Lock 10 has rear plate 46 of which rear flange 48 which is secured to front flange 42 by nuts 56 engaging bolts 30. Rear bearing block 52 is spot welded to flange 48 by welds 54, and engages shaft 36. Rear plate front flange 50 contacts front flange 16 and is secured to it by screws 26 passing through screw holes 58. As shown in FIG. 3, front plate offsets 60 and 62 together with rear plate offset 64 and flange 46 and front central portion 18 forms tube or channel 66, in which plunger 40 is mounted on shaft 36. As shown in FIG. 4, shaft 36 has cam 68 journalled into cylindrical aperture 70 in plunger 40. On rotation of cam 68 plunger 40 moves up and down, upward motion forces top serrated surface 42 into tight frictional engagement with the top surface of channel 44. Shaft 36 has square front portion 72 protruding forward of front bearing block 32 and cylindrical front portion 74 journalled into front bearing block 32, it also has cylindrical rear portion 76, which is journalled into rear bearing block 52.

Lock 10 is fixed on the side of closure 12, when the closure slides horizontally, so that when plunger 40 is lowest it clears channel top 44, by a suitable clearance as known to those skilled in the art, typically about ⅛ inch. When the handle is rotated moving plunger 40 upward, its serrated top 42 frictionally engages channel top 44. Attempts to move closure 12 toward plunger 40 rotates plunger 40 upward forcing serrated top 42 into channel top 44, increasing frictional resistance to motion. Front plate offset 60 prevents plunger 40 rotating downward and disengaging channel top 44.

Figure 6:
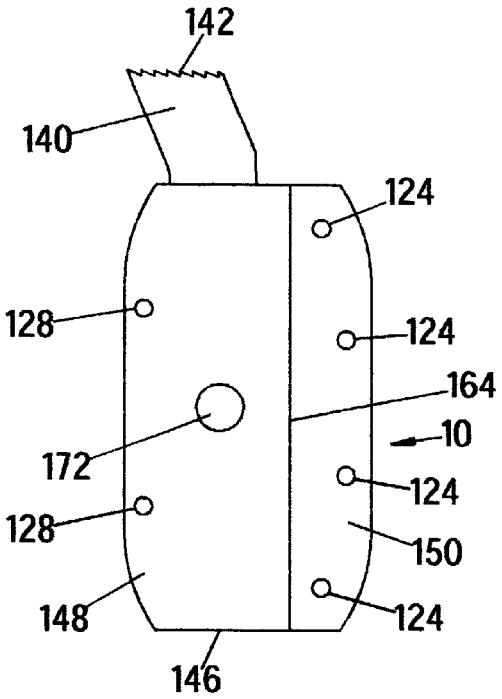
FIG. 6 shows a rear elevational view of a casing and plunger of another embodiment of the invention.
Figure 7:
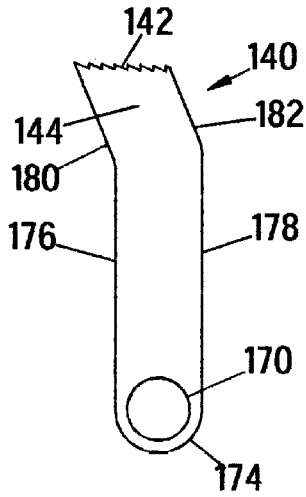
FIG. 7 shows a plunger of the embodiment of FIG. 6.
Figure 8:
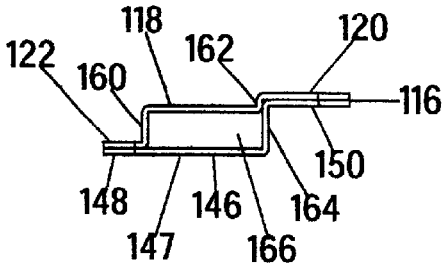
FIG. 8 shows a top plan view of the casing of FIG. 6

In FIGS. 6 to 8 is shown a variant embodiment of lock 10. Rear plate 146 has rear flange 148 securable through screw holes 128 to opposing front plate flange 122, similarly front flange 150 of rear plate 146 is securable to opposing front plate flange 120 through screw holes 124. Circular hole 172, about 5/16 inch diameter, accommodates shaft 174 as above. Plates 116 and 146 are about 4½ inches high, and are about 1/16 inch thick. Rear portion of rear plate 146, including flange 148, extends about 1¾ inch (external), offset 164 about 7/16 inch (external), rear flange 150 about ⅞ inch. Rear flange of front plate 122 extends about ⅜ inch, rear offset 160 about 7/16 inch, central channel portion 118 about 1 3/16 inch, front offset 162 about ⅛ inch, front flange 120 about 1 inch. As a result channel 66 is about 7/16 inch by about 1 3/16 inch. Plunger 140 is about ⅜ inch thick and ⅞ inch wide. It has angled end 144 with serrated top 142 to engage the inner (lower) surface of a sliding door channel. It also has hole 170, about ⅝ inch diameter to receive cam 6, concentric with round bottom 174, about ⅞ inch diameter (about 7/16 inch radius). Outer edge 176 extends about 2⅜ inch above center of hole 170 to edge 180 angled outward at 22°. Inner edge 178 extends about 2½ inch above center of hole 170, to edge 182 similarly angled at 22°. The meeting point of serrated top 142 and edge 182 is about 3 5/16 inch from center of hole 170. Edge 142 is angled upward and outward at 93° from (the projection) of edges 176 and 178.

Plunger 140 has less horizontal play than plunger 40, in rest position being essentially vertical or parallel to the edge of the door. When handle 38 and cam 68 rotate it rises to engage an upper door channel. It cannot be rotated down or away from the door, while rotating upward jams it harder in the channel.

Lock 10 could also be attached to the bottom or top of a sash window to engage lockingly a side channel or on the top of a vertically sliding door or an overhead door similarly to engage lockingly a side channel. It could further be used on the top of a portcullis to engage lockingly a side channel.

Although lock 10 could be made with an integral frame or by for example extrusion or similar processes of manufacture, from for example aluminum metal, or similar materials, it is preferred that it be made in two parts, which allows the lock to be taken apart and put together. By reversing the location of the protruding plunger end, lock 10 may be made left-handed or right handed as required, and thus fitted on either side of a sliding door or window.

As those skilled in the art would realize these preferred described details and materials and components can be subjected to substantial variation, modification, change, alteration, and substitution without affecting or modifying the function of the described embodiments.

Although embodiments of the invention have been described above, it is not limited thereto, and it will be apparent to persons skilled in the art that numerous modifications and variations form part of the present invention insofar as they do not depart from the spirit, nature and scope of the claimed and described invention.

I claim:

1. A lock for closures sliding in channels comprising a rectangular enclosure having first and second opposed ends, first, second, third and fourth wall members, said first and third wall members being opposed, parallel, and spaced apart, said second and fourth wall members being opposed, parallel and spaced apart, at right angles to and connecting said first and third wall members, a flange member operatively associated with and at right angles to said first wall member and projecting away from said rectangular enclosure, so said flange member can abut and be fastened to an inner surface of said closure, and said first wall member can abut an edge of said closure, a camshaft extending between said second and fourth wall members, parallel to said first and third wall members, having cylindrical ends journalled into said second wall member and said fourth wall member, and a cam journalled into a first end of a plunger means, said plunger means having a second serrated end projecting beyond a first end of said rectangular enclosure said camshaft when rotated moving said second serrated end of said plunger means between a first retracted position beyond said first end of said enclosure and a second extended position further beyond said first end of said enclosure, said serrated end of said plunger means being generally parallel to said channel, when touching said third wall, whereby when said flange is affixed to an inner surface of said closure, and said first wall abuts an edge of said closure, and said plunger means extends into a channel in which said closure slides, when said plunger means is in first retracted position said serrated second end does not engage a surface of said channel, when in second extended position said serrated second end frictionally engages a surface of said channel, and movement of said closure in the direction of the lock, rotates said second serrated end of said plunger means into tighter frictional engagement.

2. Lock of claim 1, wherein said cylindrical ends of said cam shaft are journalled into bearing blocks in said second and fourth wall members.

3. Lock of claim 2, wherein said bearing blocks are exterior of said wall members and welded thereto.

4. Lock of claim 1, wherein said camshaft end nearest said flange has a handle outward of said flange to rotate said camshaft.

5. Lock of claim 1, wherein said lock comprises two abutting plates, a first rear plate having a first flange to abut said closure inner surface, said first wall member joined on one side at right angles to said first flange, said fourth wall member joined at the other side of said first wall member at right angles to said first wall member and extending beyond said rectangular enclosure, a second front plate having a second flange member to fit over said first flange member, a fifth wall member joined at right angles on one side to said second flange member to fit over a portion of said first wall member, said second wall member joined at one side at right angles to the other side of said fifth wall member, said third wall member joined at right angles at one side to the other side of said second wall member, a third flange joined at right angles to the other side of said third wall member to fit over a portion of said fourth wall member, said first and second flange members having a plurality of first apertures registrable with each other to allow fasteners to pass through said first apertures and secure said flanges together to a closure surface, said third flange and said fourth wall member having a plurality of second apertures registrable with each other to allow fasteners to pass through said second apertures and secure said third flange to said fourth wall member.

6. A lock for closures sliding in channels comprising a rectangular enclosure having first and second opposed ends, first, second, third and fourth wall members, said first and third wall members being opposed, parallel, and spaced apart, said second and fourth wall members being opposed, parallel and spaced apart, at right angles to and connecting said first and third wall members, a flange member operatively associated with and at right angles to said first wall member and projecting away from said rectangular enclosure, so said flange member can abut and be fastened to an inner surface of said closure, and said first wall member can abut an edge of said closure, a camshaft extending between said second and fourth wall members, parallel to said first and third wall members, having cylindrical ends journalled into said second wall member and said fourth wall member, and a cam journalled into a first end of a plunger means, said plunger means having a second serrated end projecting beyond a first end of said rectangular enclosure, said plunger means having a first portion within said rectangular enclosure when retracted and a second portion outside said rectangular enclosure when retracted, said second portion being angled away from said closure, said camshaft when rotated moving said second serrated end of said plunger means between a first retracted position beyond said first end of said enclosure and a second extended position further beyond said first end of said enclosure, said serrated end of said plunger means being generally planar and parallel to said channel, when touching said third wall, whereby when said flange is affixed to an inner surface of said closure, and said first wall abuts an edge of said closure, and said plunger means extends into a channel in which said closure slides, when said plunger means is in first retracted position said serrated second end does not engage a surface of said channel, when in second extended position said serrated second end frictionally engages a surface of said channel, and movement of said closure in the direction of the lock, rotates said second serrated end of said plunger means into tighter frictional engagement.

7. Lock of claim 6, wherein said serrated end of said plunger means is angled away from said rectangular enclosure outward of said closure.

8. Lock of claim 7, wherein said cylindrical ends of said cam shaft are journalled into bearing blocks in said second and fourth wall members.

9. Lock of claim 8, wherein said bearing blocks are exterior of said wall members and welded thereto.

10. Lock of claim 7, wherein said camshaft end nearest said flange has a handle outward of said flange to rotate said camshaft.

11. Lock of claim 7, wherein said lock comprises two abutting plates, a first rear plate having a first flange to abut said closure inner surface, said first wall member joined on one side at right angles to said first flange, said fourth wall member joined at the other side of said first wall member at right angles to said first wall member and extending beyond said rectangular enclosure, a second front plate having a second flange member to fit over said first flange member, a fifth wall member joined at right angles on one side to said second flange member to fit over a portion of said first wall member, said second wall member joined at one side at right angles to the other side of said fifth wall member, said third wall member joined at right angles at one side to the other side of said second wall member, a third flange joined at right angles to the other side of said third wall member to fit over a portion of said fourth wall member, said first and second flange members having a plurality of first apertures registrable with each other to allow fasteners to pass through said first apertures and secure said flanges together to a closure surface, said third flange and said fourth wall member having a plurality of second apertures registrable with each other to allow fasteners to pass through said second apertures and secure said third flange to said fourth wall member.

* * * * *